US007059033B2

(12) United States Patent
Bruggemann

(10) Patent No.: US 7,059,033 B2
(45) Date of Patent: Jun. 13, 2006

(54) METHOD OF FORMING THICKENED TUBULAR MEMBERS

(75) Inventor: Charles J. Bruggemann, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 217 days.

(21) Appl. No.: 10/768,538

(22) Filed: Jan. 30, 2004

(65) Prior Publication Data

US 2005/0166382 A1 Aug. 4, 2005

(51) Int. Cl.
*B23P 17/00* (2006.01)

(52) U.S. Cl. ..... 29/421.1; 72/58; 72/61; 72/62

(58) Field of Classification Search ..... 29/421.1; 72/58, 61, 62
See application file for complete search history.

(56) References Cited

U.S. PATENT DOCUMENTS

| | | | | |
|---|---|---|---|---|
| 2,992,479 | A * | 7/1961 | Walton et al. | 29/421.1 |
| 3,579,805 | A | 5/1971 | Kast | |
| 5,170,557 | A | 12/1992 | Rigsby | |
| 5,333,775 | A | 8/1994 | Bruggemann et al. | |
| 5,720,092 | A | 2/1998 | Ni et al. | |
| 5,899,498 | A * | 5/1999 | Horton | 280/781 |
| 5,918,494 | A * | 7/1999 | Kojima et al. | 72/58 |
| 6,014,879 | A * | 1/2000 | Jaekel et al. | 72/61 |
| 6,065,502 | A * | 5/2000 | Horton | 138/177 |
| 6,183,013 | B1 | 2/2001 | Mackenzie et al. | |
| 6,474,534 | B1 | 11/2002 | Gabbianelli et al. | |
| 6,484,384 | B1 | 11/2002 | Gibson et al. | |
| 6,497,128 | B1 * | 12/2002 | Canfield et al. | 72/61 |
| 6,609,301 | B1 | 8/2003 | Morris et al. | |
| 6,654,995 | B1 | 12/2003 | Wang et al. | |
| 6,701,598 | B1 | 3/2004 | Chen et al. | |
| 6,739,166 | B1 | 5/2004 | Shah | |
| 2001/0000119 | A1 * | 4/2001 | Jaekel et al. | 296/29 |
| 2003/0204994 | A1 | 11/2003 | Norek | |

FOREIGN PATENT DOCUMENTS

| | | |
|---|---|---|
| DE | 43 37 517 A1 | 5/1995 |
| DE | 44 37 395 A1 | 5/1998 |

* cited by examiner

*Primary Examiner*—Marc Jimenez
*Assistant Examiner*—Christopher M. Koehler
(74) *Attorney, Agent, or Firm*—Laura C. Hargitt

(57) ABSTRACT

A method of forming a tubular member with thickened ends includes the steps of positioning a tubular member between open die halves and sealing ends of the tubular member. The method also includes the steps of applying at least nominal internal hydraulic pressure to the tubular member and progressively closing the die halves. The method includes the steps of raising the hydraulic pressure substantially within the tubular member to expand and conform the tubular member to the tubular cavity portion. The method further includes the steps of thickening a wall thickness of the axial ends of the tubular member, separating the die halves, and removing the tubular member having thickened axial ends from the die.

15 Claims, 2 Drawing Sheets

METHOD OF FORMING THICKENED TUBULAR MEMBERS

TECHNICAL FIELD

The present invention relates generally to forming a shaped tubular member and, more particularly, to a method of forming a thickened tubular member of hydroformed metal tubing for assembling automotive structures.

BACKGROUND OF THE INVENTION

It is known to form a cross-sectional profile of a tubular member by a hydro-forming process in which a fluid filled tubular blank is placed within a cavity of a die and then the die is closed so that the tubular blank is pinched within the die. Fluid pressure is then increased inside the tubular member to expand the blank outwardly against the cavity of the die to provide a tubular product having a die formed cross-sectional profile.

It is also known that hydroformed components are formed from ductile materials in sheet or tubular form by exerting fluid pressure to push the component material against the part defining surfaces of the cavity of the die. In the case of tubular hydroforming, in which the tube may be either rolled and welded, seamless, or extruded, the fluid that causes pressure forming is introduced through seals located at axial ends of the tube. The seals may either be of a type that lock the ends of the tube in their starting position, seal in such a way that allows some forming inducing motion of the end of the tube, or makes contact with the end of the tube to create a contact end seal. The last mentioned seal is often used to feed material into the die to enhance formability by inducing axial stress and changing the strain path of the formed material.

Axial feeding is used to enhance the ability to produce forms having a perimeter substantially larger than a starting perimeter of the tube. The typical process of hydroforming a component with axial feeding is to concurrently control the axial feeding and the internal pressure so that the die is substantially filled with material at the lowest pressure that is compatible with controlling material folding and wrinkling. During axial feeding, the seals are moved or driven into the tube axially. After achieving substantial die filling, the pressure is raised, without additional axial feeding of the seals in order to complete forming detail features of the part. In some cases, the hydroformed component produced may experience thinning or thickening as a result of various influences of part shape, e.g. part expansion, or material flow re-direction at, for example, the base of an extrudate when forming a "T" fitting, or at locations opposite the extrudate in a "T" fitting.

As a result, it is desirable to provide a new method of forming a thickened tubular member. It is also desirable to provide a method of forming a thickened tubular member by axial feeding. It is further desirable to provide a method of forming a tubular member with thickened axial ends that would allow welding of the hydroformed component in a weldable range or in a more robust welding condition. Therefore, there is a need in the art to provide a method of forming a thickened tubular member that meets these desires.

SUMMARY OF THE INVENTION

It is, therefore, one object of the present invention to provide a new method of forming a thickened tubular member.

It is another object of the present invention to provide a method of forming an axially thickened tubular member.

To achieve the foregoing objects, the present invention is a method of forming a thickened tubular member. The method includes the steps of providing a tubular member and positioning the tubular member between open die halves mating with one another to define a tubular cavity portion. The method also includes the steps of sealing ends of the tubular member. The method also includes the steps of applying at least nominal internal hydraulic pressure to the tubular member and progressively closing the die halves to progressively deform the tubular member within the tubular cavity portion. The method includes the steps of raising the hydraulic pressure substantially within the tubular member to expand and conform the tubular member to the tubular cavity portion. The method further includes the steps of thickening a wall thickness of the axial ends of the tubular member, separating the die halves, and removing the tubular member having thickened axial ends from the die.

One advantage of the present invention is that a method of forming a thickened tubular member is provided, increasing the stiffness of an end of the tubular member. Another advantage of the present invention is that the method increases the weldability of the end of the tubular member by raising the thickness of a material that is otherwise too thin to weld reliably into a valid weld range. Yet another advantage of the present invention is that the method increases the weldability of the end of a part in a joint configuration in which the weld gap is small and difficult to achieve. Still another advantage of the present invention is that the method returns the end of the tubular member to a weldable thickness for cases in which the end of the tubular member has a significant expansion that has reduced the thickness below a weldable range. A further advantage of the present invention is that the method allows long rail components to be formed at a material gage not considered weldable, thereby enabling part mass reduction with weldable ends. Yet a further advantage of the present invention is that the method improves component weld quality, improves joint stiffness, ability to use thinner gage material, thereby reducing vehicle mass.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
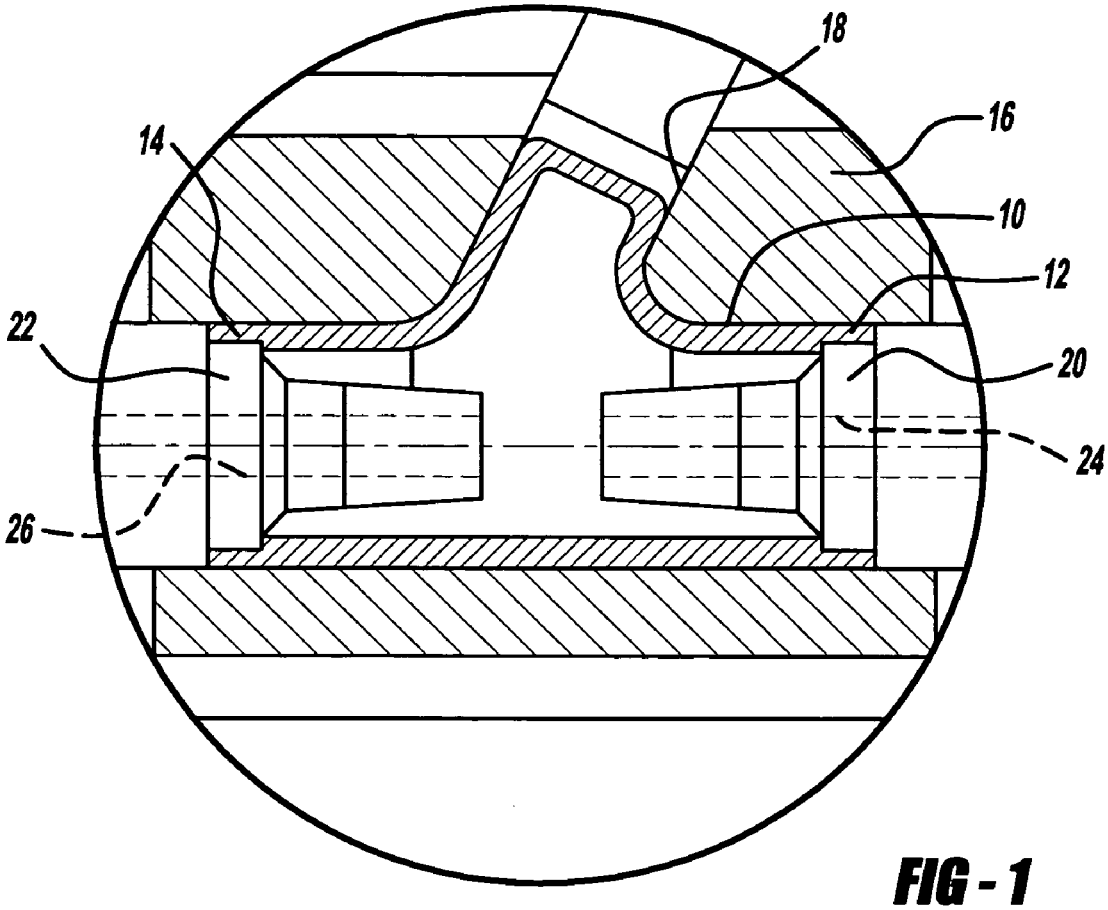
FIG. 1 is a fragmentary view of a tubular member prior to hydroforming to a desired shape of a thickened tubular member.
Figure 2:
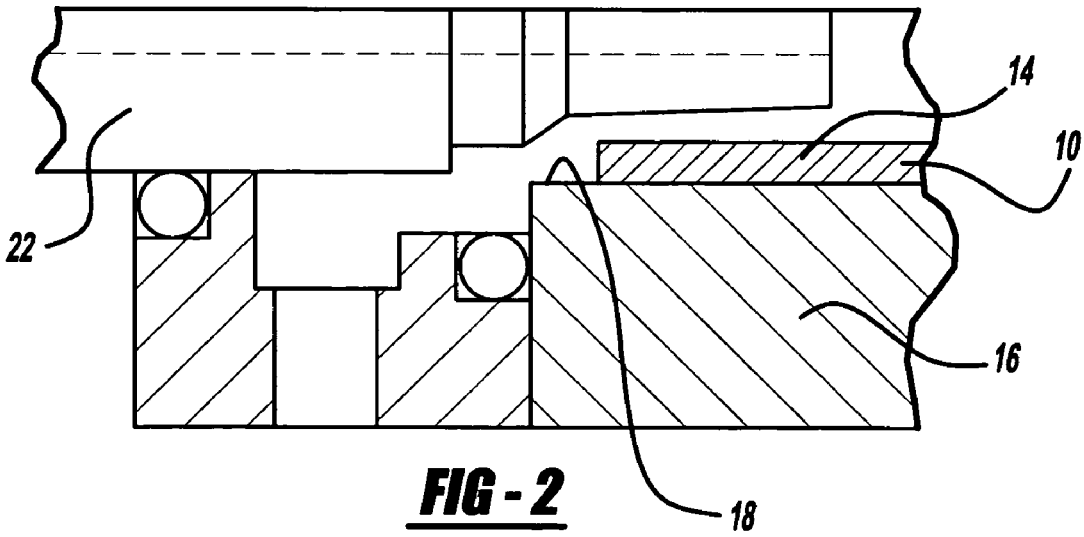
FIG. 2 is a fragmentary view of a portion of the tubular member of FIG. 1.

Referring to the drawings and in particular FIGS. 1 and 2, one embodiment of a tubular blank or member 10 is shown for use in carrying out a method, according to the present invention, of forming a thickened tubular member for assembly in automotive structures (not shown). The method includes the step of providing the tubular member 10. The tubular member 10 is made of a metal material. The tubular member 10 has a predetermined wall thickness such as 1.2 millimeters (mm). In one embodiment, the tubular member 10 has a general "T" shape with a generally circular cross-sectional shape. The tubular member 10 is hollow and has a first or right end 12 and a second or left end 14. It should be appreciated that the first end 12 and second end 14 extend axially and oppose each other. It should also be appreciated that an optimum diameter of the tubular member 10 is selected based on manufacturing and product needs.

The method also includes the step of hydroforming the tubular member 10 to form a thickened tubular member. As illustrated in FIG. 1, the tubular member 10 is placed in a die set comprised of a first die half 16 and a second die half (not shown). The first die half 16 includes a tubular forming cavity portion 18. Likewise, the second die half includes a tubular forming cavity portion (not shown).

The method also includes the step of sealing the first and second ends 12 and 14 of the tubular member 10 with first and second seals 20 and 22, respectively. The first seal 20 has an aperture 24 extending axially therethrough and the second seal 22 has an aperture 26 extending axially therethrough for feeding of a hydraulic fluid for hydroforming the tubular member 10. It should be appreciated that the first and second seals 20 and 22 make contact with the first and second ends 12 and 14 to create a contact end seal.

The method includes the step of applying at least nominal internal hydraulic pressure to the tubular member 10. The nominal internal hydraulic pressure is applied by pumping hydraulic fluid through the seals 20 and 22 and into the tubular member 10 under pressure. The first and second die halves are progressively closed so that the tubular member 10 is contained within the die and the pressurized fluid captured therein expands the walls of the tubular member 10 into the cavity 18 of the die.

The method includes the step of fully closing the die halves upon one another with the tubular member 10 being tightly clamped between the die halves. During this closing of the die halves, a relatively constant hydraulic pressure may be maintained within the tubular member 10 by incorporating a pressure control valve (not shown) into the seals 20 and 22 enclosing the ends 14 and 16 of the tubular member 10 so that hydraulic fluid may be forced from the tubular member 10 as it collapses.

Once the die is closed, the tubular member 10 is then expanded to a final cross-sectional profile by increasing the hydraulic pressure sufficient to exceed the yield limit of the tubular member 10 so that the tubular member 10 is forced into conformity with the tubular forming cavity 18 of the die halves. The method includes the steps of feeding axially the seals 20 and 22 into the ends 12 and 14 of the tubular member 10 and increasing the hydraulic pressure to expand and conform the tubular member 10 to the tubular cavity portion 18. The method further includes the steps of additional end feeding of tube wall material to the tubular member 10 by feeding axially the seals 20 and 22 further into the ends 12 and 14 of the tubular member 10 and stopping or terminating the additional end feeding after a predetermined time period. The method includes increasing the hydraulic pressure in the tubular member 10 after stopping or terminating the additional end feeding.

The method includes the steps of opening the die halves and removing the hydroformed tubular member with the ends 12 and 14 having a thickened wall thickness greater than the original wall thickness before hydroforming. For example, the wall thickness before hydroforming may be 1.2 mm and the wall thickness after hydroforming may be greater than 1.3 mm for a distance of 10 mm from the end of the first and second ends 20 and 22. The hydroformed tubular member may be assembled into a vehicle body (not shown). It should be appreciated that the ends of the part to be formed by axial feed forming are intentionally thickened by providing specifically modified pressure and material end feeding that are imposed near what would normally be considered the end of the forming cycle.

Figure 3:
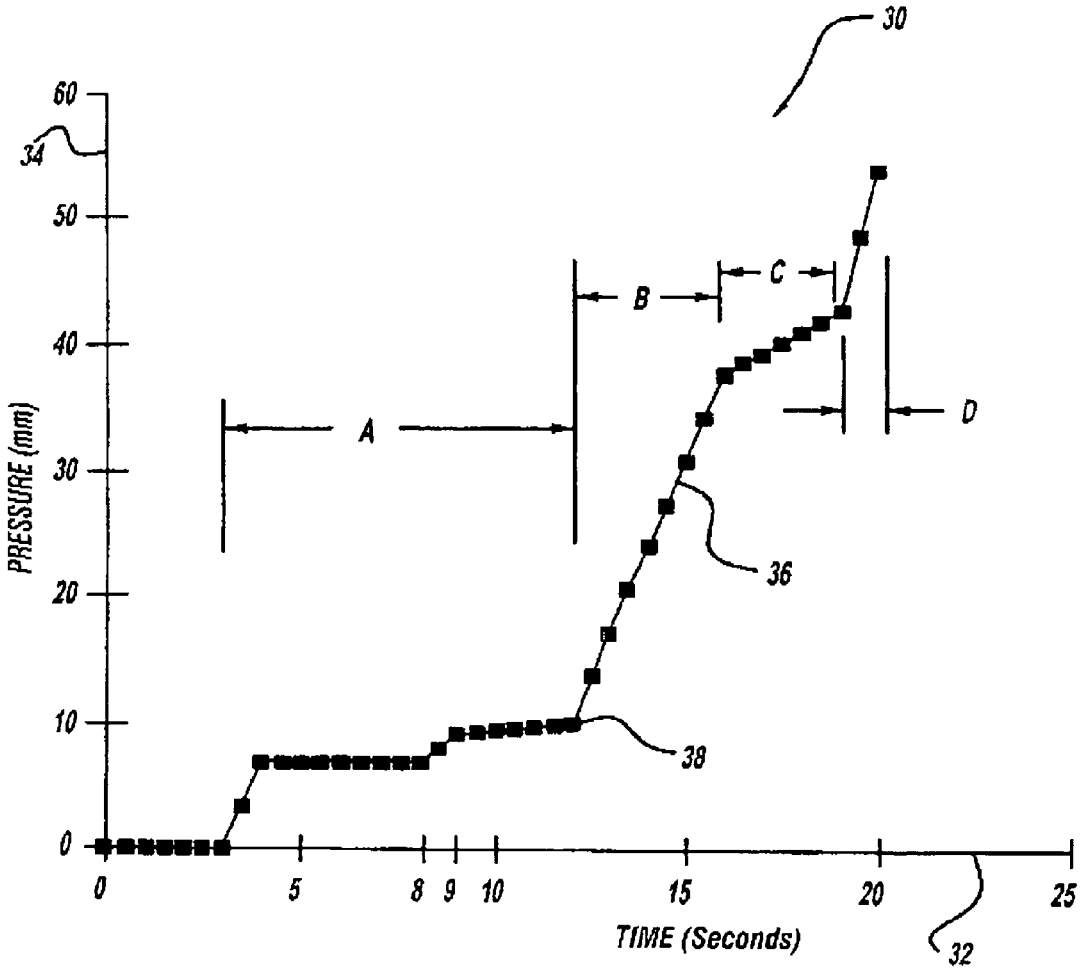
FIG. 3 is a graph of pressure versus time for a method, according to the present invention, of forming thickened tubular members.

Referring to FIG. 3, a graph, generally indicated at 30, for feeding of the hydraulic fluid in the tubular member 10 is shown. As illustrated, the graph 30 has an x-axis 32 of time and a y-axis 34 of pressure of the hydraulic fluid. The graph 30 also has a curve 36 of time versus pressure of the hydraulic fluid for hydroforming of the tubular member 10. The curve 36 has a first part A that corresponds to subjecting the tubular member 10 to a normal forming cycle by increasing internal pressure within the tubular member 10 while axially feeding material into the die. During the first part A, the seals 20 and 22 are moved or driven axially into the ends 12 and 14 of the tubular member 10. The axial feeding is stopped at point 38 on the curve 36. The curve 36 has a second part B that corresponds to raising the pressure substantially of the hydraulic fluid in the tubular member 10. This causes the tube wall material to be expanded to conform to the die walls. During the second part B, the seals 20 and 22 are not moving, but the pressure is raised inside the tubular member 10. The curve 36 has a third part C that corresponds to additional end feeding of the tube material at a controlled high pressure. During the third part C, the seals 20 and 22 are again moved or driven axially further into the ends 12 and 14 of the tubular member 10. The curve 36 has a fourth part D that corresponds to some additional pressure increase without feeding tube material for final part feature refinement. During the fourth part D, the seals 20 and 22 are not moving, but the pressure is raised inside the tubular member 10. It should be appreciated that the feeding action at high pressure in the third part C of the curve 36 in combination with any locally controlled die surface features, for example roughness, etc., provide a high friction condition that limits the ability of the end feeding from pushing material into the die. It should also be appreciated that, as a result, only those regions in the vicinity of the end feed piston absorb material by means of a local, desirable increase in thickness.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A method of forming a tubular member with thickened ends comprising the steps of:

providing a tubular member;

positioning the tubular member between open die halves mating with one another to define a tubular cavity portion;

sealing ends of the tubular member;

applying at least nominal internal hydraulic pressure to the tubular member;

progressively closing the die halves to progressively deform the tubular member within the tubular cavity portion;

raising the hydraulic pressure substantially within the tubular member to expand and conform the tubular member to the tubular cavity portion;

thickening a wall thickness of the axial ends of the tubular member wherein said step of thickening comprises feeding wall material of the tubular member at a controlled high pressure after said step of raising;

separating the die halves; and removing the tubular member having thickened axial ends from the die.

2. A method as set forth in claim 1 including the step of stopping the feeding after a predetermined time period.

3. A method as set forth in claim 2 including the step of increasing the hydraulic pressure in the tubular member without feeding wall material of the tubular member after said step of stopping.

4. A method as set forth in claim 1 wherein said step of sealing comprises sealing the ends of the tubular member with seals.

5. A method as set forth in claim 4 wherein said step of sealing includes the step of creating a contact end seal with the seals.

6. A method as set forth in claim 1 wherein the ends of the tubular member have thickened ends for a predetermined distance.

7. A method as set forth in claim 1 wherein the tubular member is made of a metal material.

8. A method of forming a tubular member with thickened ends comprising the steps of:

providing a metal tubular member having axial ends;

positioning the tubular member between open die halves mating with one another to define a tubular cavity portion;

sealing the axial ends of the tubular member with seals;

applying at least nominal internal hydraulic pressure to the tubular member through the seals;

progressively closing the die halves to progressively deform the tubular member within the tubular cavity portion;

feeding axially the seals into the ends of the tubular member;

raising the hydraulic pressure substantially within the tubular member after terminating the feeding to expand and conform the tubular member to the tubular cavity portion;

thickening a wall thickness of the axial ends of the tubular member;

separating the die halves; and removing the tubular member having thickened axial ends from the die.

9. A method as set forth in claim 8 wherein said step of thickening comprises feeding axially the seals further into the axial ends of the tubular member at a controlled high pressure after said step of raising.

10. A method as set forth in claim 9 including the step of stopping the feeding after a predetermined time period.

11. A method as set forth in claim 10 including the step of increasing the hydraulic pressure in the tubular member without feeding axially the seals into the axial ends of the tubular member after said step of stopping.

12. A method as set forth in claim 8 wherein said step of providing a tubular member comprises providing a tubular member having a generally circular cross-sectional shape.

13. A method as set forth in claim 8 wherein said step of sealing includes the step of creating a contact end seal with the seals.

14. A method as set forth in claim 8 wherein the ends of the tubular member have thickened ends for a predetermined distance.

15. A method of forming a tubular member with axially thickened ends comprising the steps of:

providing a metal tubular member having axial ends;

sealing the ends of the tubular member with seals;

positioning the tubular member between open die halves mating with one another to define a tubular cavity portion;

applying at least nominal internal hydraulic pressure to the tubular member through the seals;

progressively closing the die halves to progressively deform the tubular member within the tubular cavity portion;

feeding axially the seals into the ends of the tubular member;

raising the hydraulic pressure substantially within the tubular member after terminating the feeding to expand and conform the tubular member to the tubular cavity portion;

feeding axially the seals further into the axial ends of the tubular member at a controlled high pressure and thickening a wall thickness of the axial ends of the tubular member;

separating the die halves; and removing the tubular member having thickened axial ends from the die.

* * * * *